US006332289B1

(12) United States Patent
Chu

(10) Patent No.: US 6,332,289 B1
(45) Date of Patent: Dec. 25, 2001

(54) RUNNER FOR SUPPORTING A WINDOW IN A VEHICLE DOOR WINDOW LIFTER

(75) Inventor: Yi-Hwa M. Chu, Ouzouer S/Loire (FR)

(73) Assignee: Meritor Light Vehicle Systems - France (FR)

( * ) Notice: Subject to any disclaimer, the term of this patent is extended or adjusted under 35 U.S.C. 154(b) by 0 days.

(21) Appl. No.: 09/332,291

(22) Filed: Jun. 11, 1999

(30) Foreign Application Priority Data

Jun. 12, 1998 (FR) ..... 98 07458

(51) Int. Cl.[7] ..... E05F 11/38
(52) U.S. Cl. ..... 49/375; 411/41; 411/45
(58) Field of Search ..... 49/348, 349, 352, 49/404, 502, 374, 375; 411/41, 45, 46, 48, 57.1, 508, 509

(56) References Cited

U.S. PATENT DOCUMENTS

| | | | | |
|---|---|---|---|---|
| 4,095,370 | | 6/1978 | Muehling | 49/352 |
| 4,442,633 | | 4/1984 | Gianotti | 49/375 |
| 4,656,780 | * | 4/1987 | Miyauchi et al. | 49/352 X |
| 4,788,795 | * | 12/1988 | Pinsonneault | 49/349 X |
| 5,005,316 | * | 4/1991 | Hornivius | 49/348 |
| 5,341,599 | * | 8/1994 | Cox | 49/375 |
| 5,363,595 | * | 11/1994 | Wirsing | 49/375 |
| 5,537,783 | * | 7/1996 | Kazino et al. | 49/375 |
| 5,540,528 | * | 7/1996 | Schmidt et al. | 411/41 X |
| 5,694,719 | * | 12/1997 | Bejune | 49/348 X |

FOREIGN PATENT DOCUMENTS

| | | |
|---|---|---|
| 4239601 | 5/1994 | (DE) . |
| 4321616 | 1/1995 | (DE) . |
| 4440170 | 5/1996 | (DE) . |
| 1193949 | 6/1970 | (GB) . |

* cited by examiner

*Primary Examiner*—Jerry Redman
(74) *Attorney, Agent, or Firm*—Carlson, Gaskey & Olds, P.C.

(57) ABSTRACT

A window runner includes a clip-in member that engages a hole in a window to attach the window runner to the window. A locking member, in the form of a screw pre-mounted on the runner, is introduced into a central orifice of the clip from the side of the window which faces toward the interior of the vehicle. Flexible tabs extending from the clip lock into the periphery of the window hole. It is therefore extremely difficult to detach the clip from outside the vehicle. In consequence, any unauthorized lowering of the window by detaching the window clip-in member is no longer possible.

2 Claims, 1 Drawing Sheet

RUNNER FOR SUPPORTING A WINDOW IN A VEHICLE DOOR WINDOW LIFTER

BACKGROUND OF THE INVENTION

The subject of the present invention is a cursor or runner for supporting a window in a vehicle door window lifter.

Commonly known window runners fit on a guiderail and are driven by a cable. The runner comprises a body and a window connection. The connection is generally a peg passing through a hole in the window and supplemented by a key or "fork" for locking it to the window. The runner peg is introduced through the hole in the window and the key is slipped along that face of the window. The key faces toward the exterior of the vehicle between the end of the peg and the surface of the window to lock the peg in place.

The peg pulls or pushes the window as the latter moves down and up. In this type of connecting system, the locking key is accessible from outside the vehicle. This is not particularly desirable for security reasons.

Other known embodiments for providing the connection between the window and the runner involve passing through the rail in order to lock the window.

It is desirable to provide a window support runner which makes the locking element inaccessible from outside the vehicle. Unauthorized lowering of the window and fraudulent opening of the vehicle door is therefore prevented. It is further desirable to lock and unlock the runner from inside the vehicle without requiring an access opening through the guiderail.

SUMMARY OF THE INVENTION

The present invention provides a clip-in member or clip which elastically clips into a hole in a window to attach a window runner to the window.

A locking member, preferably a screw pre-mounted on the runner, is introduced into the clip from the side of the window which faces toward the interior of the vehicle. The clip preferably includes several flexible tabs arranged around a central passage. The tab ends form catches that press against the edge of the hole in the window when the locking member is inserted.

The locking member is screwed into the elastic clip to securely lock it to the window. The locking member is preferably attached to the side of the window that faces toward the interior of the vehicle thereby being inaccessible from outside the vehicle.

To further retain the clip, the end catches of the flexible tabs lock into the periphery of the hole in the window. It is therefore extremely difficult to detach the clip from the window from outside the vehicle. In consequence, any unauthorized lowering of the window by detaching the window clip-in member is no longer possible.

The present invention provides further advantages. Locking and unlocking can be performed from inside the vehicle without requiring an access opening through the guiderail. Disconnecting does not require passing through the window mounting as the mounting does not pass through a hole in the guiderail. Locking the runner and window connection is quicker as the locking key has been dispensed with.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
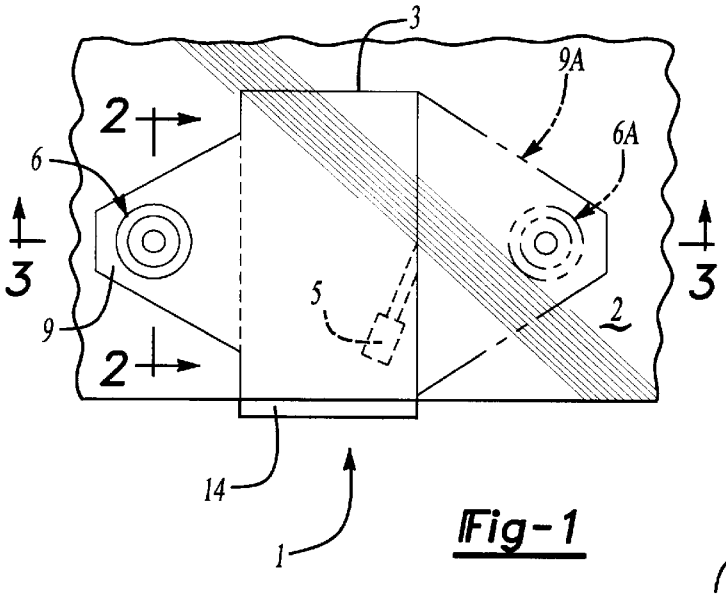
FIG. 1 is a top view of a first embodiment of the window support runner according to the present invention.

FIG. 1 illustrates a runner 1 or cursor for supporting a window 2 in a vehicle door window regulator or lifter (the door not being depicted).

The runner 1 includes a body 3 having a slot 10 designed to allow the body to fit on a guiderail 4. Alternatively, the runner 1 can be driven by a cable (not depicted.) The cable end termination being received in a housing 5 (shown in phantom) of the body 3.

The runner 1 is connected to the window 2 by a clip-in member 6 which elastically clips into a hole 7 in the window 2. The clip-in member 6 receives a locking member 8 or 17 from that side of the window 2 which faces toward the interior of the vehicle.

The clip-in member 6 is formed on a lateral lug 9 of the body 3 and preferably includes at least two flexible tabs 11. The tabs 11 are formed integrally with the lug 9 and arranged around a central orifice or passage 12 on each side. The tabs 11 can preferably flex in a radial direction.

Figure 3:
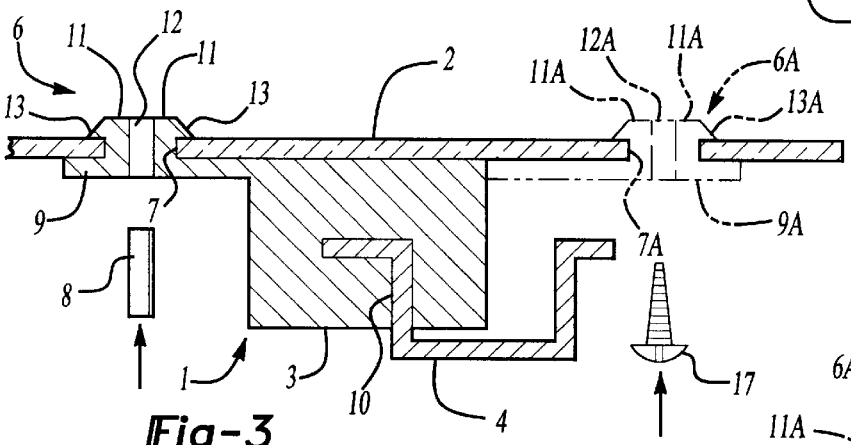
FIG. 3 is a sectional view of the window lifter along the line 3—3 of FIG. 1 illustrating an alternative form of the runner according to the present invention.

A catch 13 extends from the tabs 11. The catch 13 press against the exterior face of the window 2 after they have flexed radially toward the central passage 12 as the clip-in member 6 is introduced into the hole 7 in the window 2. The locking member, for example a pin 8 or a screw 17 (FIG. 3) can be pre-mounted (screw 17) or integral with the runner 1 (pin 8) when the latter is molded. The pin 8 is thus partially introduced into the passage 12 as the runner 1 is removed from the mold. The screw 17 being screwed into the axial passage 12, or the pin 8 being fully introduced into the axial passage 12, from inside the vehicle.

Figure 2:
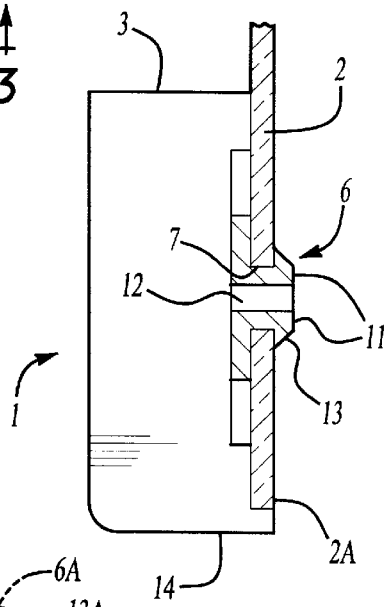
FIG. 2 is a sectional view of the window lifter along the line 2—2 of FIG. 1.

To avoid unwanted torque between the lateral clip 6 and the rail 4 as well as the cable, the invention provides an additional means of driving the runner 1. In the embodiment illustrated in FIGS. 1 and 2, a toe 14 projects transversely under the body 3 of the runner 1 and under the lower edge 2*a* of the window 2. The latter can be lifted when the window lifter is actuated in the lifting direction. The pushing toe 14 therefore avoids the aforementioned unwanted torque.

Figure 4:
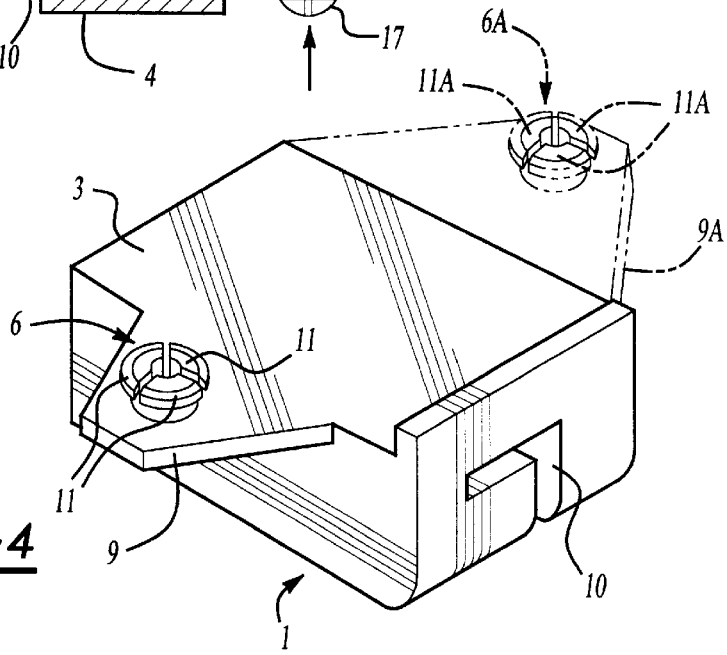
FIG. 4 is a perspective view of the window support runner of FIG. 1.

According to another embodiment of the present invention, a second clip 6*a* (shown in phantom in FIGS. 1, 3 and 4) is formed with a second lateral lug 9*a*. Its design is identical to that of the clip-in member 6 (flexible tabs 11*a*, axial passage 12*a*), it being possible for the tabs 11*a* to be clipped elastically into a second hole 7*a* symmetric with the hole 7 with respect to the runner 1. This second clip-in member 6*a* supplements the first member 6, thereby eliminating unwanted torque, and thus making the lower pushing toe 14 superfluous.

Just as was the case with the clip-in member 6, the second clip-in member 6*a* may be locked from inside the vehicle by means either of a pin 6 or of a screw 17 or of any other equivalent element.

The present invention therefore makes it practically impossible for the window to be unlocked from the runner from outside the vehicle and improves the anti-theft security thereof.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A runner assembly for supporting a window along a guiderail in a vehicle door window regulator, comprising:

a substantially box-shaped body having a substantially L-shaped slot for receipt of the guiderail;

a toe extending from a bottom face of said body, said toe for extending below and supporting a lower edge of the window;

a lateral lug extending from said body;

a clip having a plurality of flexible tabs and a central orifice, said clip mounted to said lateral lug and insertable within a hole in the window from the side of the window which faces toward a vehicle door interior;

a catch extending from each of said flexible tabs, said catch engagable with a side of the window which faces away from the vehicle door interior; and a locking member insertable within said central orifice from the side of the window which faces toward the vehicle door interior, said locking member operable to radially expand said clip within said hole, said tabs radially expandable upon insertion of said locking member within said central orifice.

2. A runner as recited in claim 1, wherein said locking member is a threaded member having a head facing the vehicle interior.

* * * * *